United States Patent [19]

Gindele

[11] 4,051,788

[45] Oct. 4, 1977

[54] FOLDING TABLE

[76] Inventor: William E. Gindele, East Boothbay, Maine 04544

[21] Appl. No.: 678,688

[22] Filed: Apr. 20, 1976

[51] Int. Cl.[2] ..... A47B 3/00

[52] U.S. Cl. ..... 108/125; 108/129

[58] Field of Search ..... 108/125, 129, 131-133

[56] References Cited

U.S. PATENT DOCUMENTS

| | | | |
|---|---|---|---|
| 1,289,739 | 12/1918 | Hahn | 108/125 |
| 1,675,355 | 7/1928 | King | 108/125 |
| 2,049,221 | 7/1936 | Rastetter | 108/129 |
| 2,159,564 | 5/1939 | McPherson | 108/125 X |
| 2,204,081 | 6/1940 | Harrell | 108/129 |
| 2,227,871 | 1/1941 | Wigell | 108/125 X |
| 2,653,066 | 9/1953 | Anderson | 108/129 |

FOREIGN PATENT DOCUMENTS

| | | | |
|---|---|---|---|
| 87,254 | 9/1936 | Sweden | 108/125 |

*Primary Examiner*—Roy D. Frazier
*Assistant Examiner*—Darrell Marquette

[57] ABSTRACT

A folding table is comprised of a table top and frame of side rails, and includes at each corner formed by the side rails, a further rail attached to the underside of the top forming a channel with one of the side rails. A leg is pivotally attached at each corner on an axis perpendicular to the opposing walls of the channel formed. A locking means is carried within a recess of the further rail which, when a leg is unfolded to its extended position, will be effective under spring loading, to provide a bearing against the leg for locking it into extended position. Pressure on the locking means to force it into the recess, releases the leg for folding. When the legs are in the folded or unfolded position, the locking mechanism is completely hidden.

4 Claims, 5 Drawing Figures

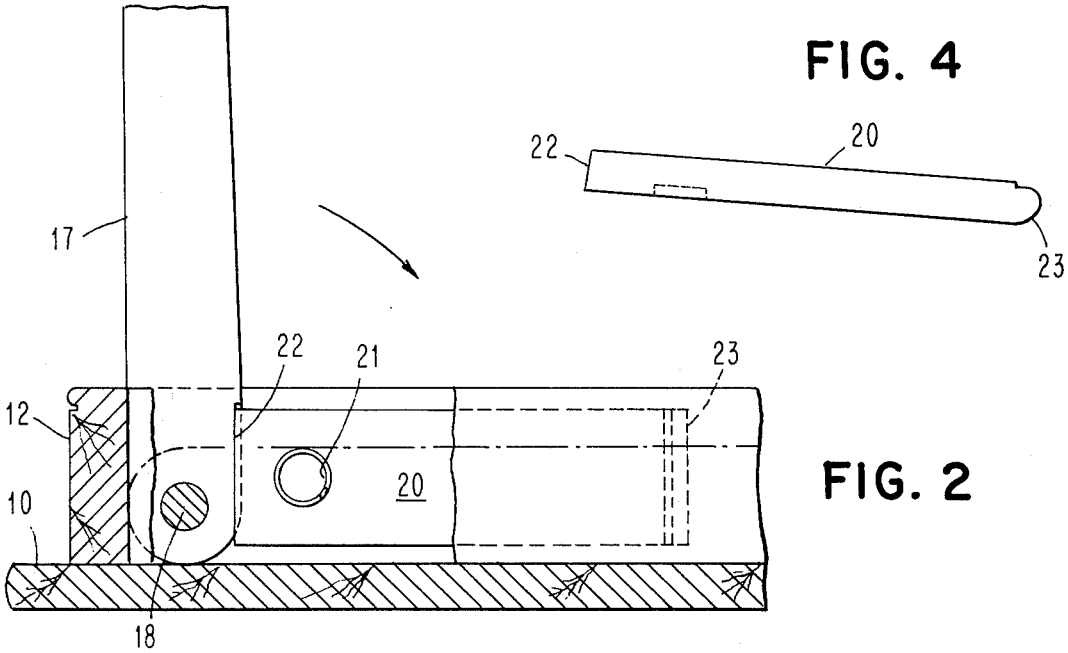
FIG. 2
FIG. 4
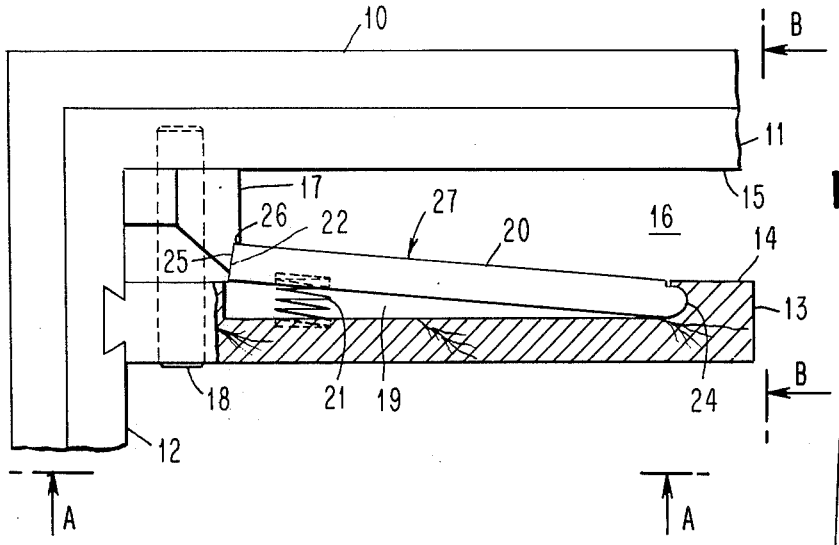
FIG. 1
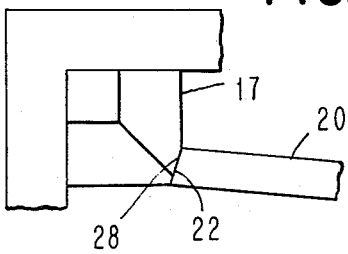
FIG. 5
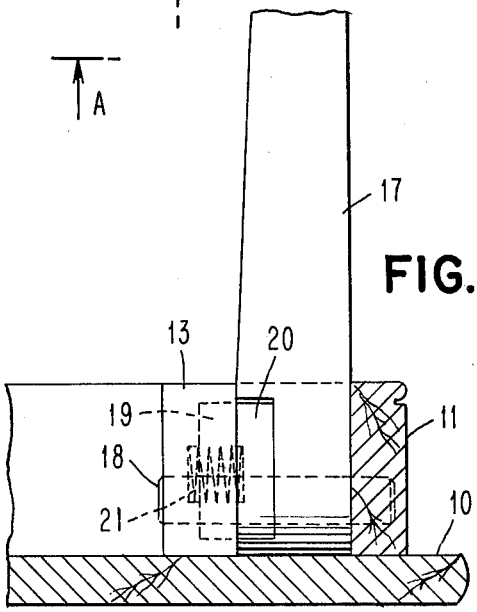
FIG. 3

FOLDING TABLE

BACKGROUND OF THE INVENTION

The present invention relates to folding tables, and in particular to a table with folding legs in which the locking mechanism is completely hidden from view when legs are in the folded or unfolded position.

Many folding tables exist which include a mechanism which is designed to facilitate folding and extending the legs, and which is also designed to provide leg stability when the leg is in the extended position. All of these folding tables require a mechanism which usually involves metallic connections, linkages, and springs, all of which are exposed when the table is either in the folded or extended position.

SUMMARY OF THE INVENTION

It is an object of the present invention to provide a folding table in which ease of operation, and leg locking and stability is achieved utilizing a locking mechanism completely hidden from view, whether the legs are in the extended or folded position.

This object is achieved with a locking mechanism in the form of a substantially rectangular block retained in a recess of a rail which faces a side rail at a corner, and which forms a channel for receiving a leg in the folded position. The rectangular block, representing the locking mechanism, is spring loaded to pivotally urge the block out of the recess to engage the leg when in the extended position for purpose of locking. In view of the fact that the locking mechanism is retained in a recess in the innerface of the channel formed, it is completely hidden from view when the leg is either in the extended or folded position. The locking means, side rails, and further rail provide stability by virtue of a bearing relationship on all four sides of the leg.

BRIEF DESCRIPTION OF DRAWINGS

FIG. 1 is a plan view of one corner of a folding table showing the locking mechanism engaging a leg in the extended position.

FIG. 2 is an elevation view along the line AA of FIG. 1.

FIG. 3 is an elevation view along the line BB of FIG. 1.

FIG. 4 shows the configuration of a locking means.

FIG. 5 shows a modification of the locking mechanism and configuration of a leg, in the extended position of the leg.

DETAILED DESCRIPTION OF THE INVENTION

FIGS. 1, 2 and 3 show various views of the invention. The following description primarily refers to FIG. 1.

FIG. 1 is a plan view of a folding table comprised of a top 10 and side rails 11 and 12 which provide a frame and corner. A further partial rail 13 is attached to the underside of the top 10 and side rail 12 to form, by virtue of an inner surface 14 facing the surface 15 of side rail 11, a channel 16 which will receive a leg 17 when in its folded position. The leg 17 is pivoted by means of a dowel 18 on an axis which is perpendicular to the opposing surfaces 14 and 15.

A substantially rectangular recess 19 in the innerface 14 of the further rail 13 receives a substantially rectangular locking means 20. The locking means 20 and further rail 13 contain a circular recess for receiving a coil spring 21 which is effective to urge the locking means 20 towards the side rail 11.

Referring to FIG. 4, the locking means 20 is shown to include at a leg bearing end thereof 22, a slight level, and at the opposite end thereof a convex rounded end 23. Corresponding to the rounded end 23 of the locking means 20 is a concave rounded portion 24 in the recess 19, which when the locking means 20 is inserted into the recess 19 provides a pivot point.

Each of the legs will have a bearing surface to cooperate with the bearing surface 22 of the locking means 20. In FIG. 1, the bearing surface of the leg is shown to include a notch which provides a lock bearing surface 25 and a surface 26 which will be effective to engage the end 22 of the locking means 20 to limit the effect of the spring 21 urging the locking means towards the side rail 11.

FIG. 1 shows the leg 17 in the extended position and locked by means of the locking means 20. Pressure applied to the locking means at 27, against the spring 21, will be effective to cause locking means 20 to be forced into the recess 19 releasing the leg 17 to be folded into the channel area 16.

FIGS. 2 and 3 show different elevation views of the mechanism previously described in connection with FIG. 1, and common elements have been similarly numbered.

FIG. 5 shows a slight variation of the relationship between the leg bearing end 22 of the locking means 20 and the lock bearing surface of the leg 17. A beveled corner 28 is provided on the leg 17 to cooperate with the bevel 22 of the locking means 20. Through urging of the spring 21, the bearing surfaces 22 and 28 cooperate to provide not only limiting action to the spring, but the locking and bearing relationship required, which relationship is in effect a wedging action.

What is claimed is:

1. In a table having folding legs:

a top, a frame of side rails, a further rail attached to said top associated with each corner formed by said side rails, having a wall facing an opposing wall of one of said rails which creates a channel for receiving a leg when in its folded position, pivot means attaching each leg to the table having an axis perpendicular to the opposing walls of said further rail and one of said side rails;

locking means comprised of a substantially rectangular block having a leg bearing end and an opposite end, said leg bearing end being beveled and said opposite end having a convex rounded configuration, a recess in said further rail, said recess being configured in a substantially rectangular shape and includes a concave, rounded end for receiving said convex, rounded end of said locking means to thereby provide a pivot point for said locking means, and retain said locking means within said recess when said leg is in its folded position, and means to force said locking means towards said opposing wall of said side rail.

2. A table having folding legs in accordance with claim 1 wherein:

each said leg includes a bearing surface cooperating with said leg bearing end of said locking means , to limit the effect of said forcing means.

3. A table having folding legs in accordance with claim 2 wherein:

said bearing surface is comprised of a corner cut-out having one surface as said bearing surface, and a second surface for limiting the effect of said forcing means.

4. A table having folding legs in accordance with claim 2 wherein:

said bearing surface is comprised of a corner bevel cooperating with said beveled leg bearing end of said locking means, to thereby create a wedging action.

* * * * *